US011761636B2

(12) United States Patent
Muller

(10) Patent No.: US 11,761,636 B2
(45) Date of Patent: Sep. 19, 2023

(54) DECORATIVE DEVICE WITH FLAMES THAT CAN BE RAISED AND LOWERED

(71) Applicant: TBF-PYROTEC GMBH, Geesthacht (DE)

(72) Inventor: Christoph Muller, Hamburg (DE)

(73) Assignee: TBF-PYROTEC GMBH, Geesthact (DE)

( * ) Notice: Subject to any disclaimer, the term of this patent is extended or adjusted under 35 U.S.C. 154(b) by 292 days.

(21) Appl. No.: 17/290,768

(22) PCT Filed: Oct. 25, 2019

(86) PCT No.: PCT/EP2019/079300
§ 371 (c)(1),
(2) Date: May 2, 2021

(87) PCT Pub. No.: WO2020/089127
PCT Pub. Date: May 7, 2020

(65) Prior Publication Data

US 2022/0003418 A1 Jan. 6, 2022

(30) Foreign Application Priority Data

Nov. 2, 2018 (DE) ..... 10 2018 127 376.2

(51) Int. Cl.

| | |
|---|---|
| ***F24C 3/12*** | (2006.01) |
| ***B66D 1/60*** | (2006.01) |
| ***A63J 1/02*** | (2006.01) |
| ***A63J 5/02*** | (2006.01) |
| ***F24C 3/10*** | (2006.01) |

(52) U.S. Cl.
CPC ..... *F24C 3/122* (2013.01); *B66D 1/60* (2013.01); *A63J 1/028* (2013.01); *A63J 5/023* (2013.01); *F24C 3/103* (2013.01)

(58) Field of Classification Search
CPC ..... F23Q 9/06; F21V 21/36; F21V 21/38
USPC ..... 431/100–113, 258, 298–325; 362/179, 362/407
See application file for complete search history.

(56) References Cited

U.S. PATENT DOCUMENTS 1,220,234 A * 3/1917 Kaufman ..... F23D 11/44 431/220
4,817,529 A 4/1989 Schippers
(Continued)

FOREIGN PATENT DOCUMENTS

CN 1580631 A 2/2005
CN 102901063 A 1/2013
(Continued)

*Primary Examiner* — Vivek K Shirsat
(74) *Attorney, Agent, or Firm* — Bay State IP, LLC

(57) ABSTRACT

A decorative device which includes at least one controllable winch (8) which is intended for unwinding and winding up an elongated non-rigid element (4), and the elongated non-rigid element (4) is connected to a respective burner (11) at one end (6) and to the at least one winch (8) at the other end (7), and the burner (11) can be moved down towards the floor (1) and up away from the floor (1) with the unwinding and winding up of the elongated non-rigid element (4), characterised in that the burner (11) can be ignited to generate a flame by means of an igniter via a controller (9) arranged outside the burner (11).

11 Claims, 2 Drawing Sheets

(56) References Cited

U.S. PATENT DOCUMENTS

Figure 1:
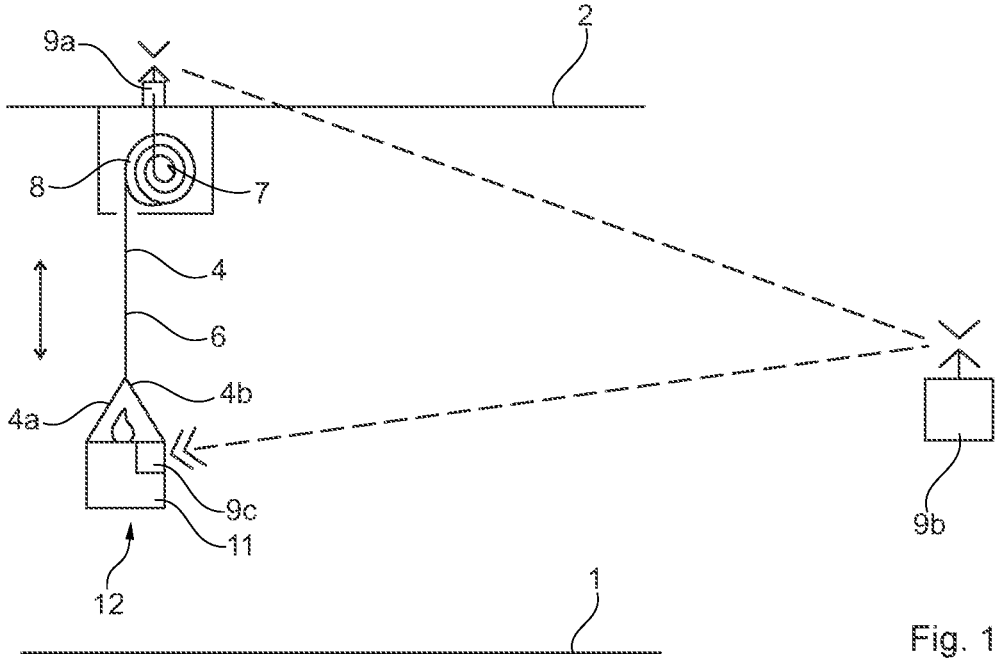

| | | | | |
|---|---|---|---|---|
| 2003/0178944 | A1* | 9/2003 | Willamor | F23Q 7/24 315/91 |
| 2008/0074893 | A1* | 3/2008 | Ham | F21V 21/38 362/403 |
| 2018/0072965 | A1 | 3/2018 | Han | |

FOREIGN PATENT DOCUMENTS

| | | | |
|---|---|---|---|
| DE | 10 2015 100 998 | A1 | 7/2016 |
| EP | 2 366 252 | B1 | 9/2011 |
| WO | 2008/074269 | A1 | 6/2008 |

* cited by examiner

DECORATIVE DEVICE WITH FLAMES THAT CAN BE RAISED AND LOWERED

CROSS REFERENCE TO RELATED APPLICATION

This application is for entry into the U.S. National Phase under § 371 for International Application No. PCT/EP2019/079300 having an international filing date of Oct. 25, 2019, and from which priority is claimed under all applicable sections of Title 35 of the United States Code including, but not limited to, Sections 120, 363, and 365(c) and which in turn claims priority under 35 USC 119 to German Patent Application No. 10 2018 127 376.2 filed on filed on Nov. 2, 2018.

The invention relates to a decorative device comprising at least one controllable winch which is intended for unwinding and winding up an elongated non-rigid element, and the elongated non-rigid element is connected to a burner at one end and to the at least one winch at the other end, and the burner can be moved down towards the floor and up away from the floor with the unwinding and winding up of the elongated non-rigid element.

Decorative devices are known in the prior art. A winch and a system of winches are known from EP 2 466 252 B1. Each of the winches has a cable which can be wound onto the winch and which is characterised in that it is rectangular in cross-section and the width of the cross-section is variable and corresponds to a distance between flanks of the cable winch, so that the cable can be wound particularly exactly on the cable, so that no zigzag pattern is formed in the roll. A lamp is attached to the free end of the cable; the winches can be connected to one another by means of a controller and can be jointly controlled.

A remote-controlled light source with a flame is known from WO 2008/074269 A1.

A device for arranging a load in a desired position of a stage space is disclosed in DE 2015 100 998 A1.

A disadvantage of the known decorative device is that the presentation is not very lively. The presentation is artificial and static.

Therefore it is an object of the present invention to provide a decorative device which creates a visually more lively impression.

This object is achieved by a decorative device as mentioned above with the features of claim 1.

According to the invention a burner is provided which produces a flame. The burner comprises a preferably controllable valve, an igniter and a fire space in which the flame can form. The fire space does not have to have a boundary. It may also be a space which is available for the flame. The burner can have a fuel reservoir for LPG (liquefied petroleum gas) or another combustible liquid or gas, for example alcohols. The controllable valve is provided in order to control or regulate the flow of gas or liquid.

The igniter is preferably designed as an electric arc igniter, piezoelectric igniter, glow igniter or pyrotechnic igniter. The burner can have a burner nozzle.

A particularly lively impression can be created by the ignition of a real flame and preferably an open flame. The burner is movable up from the floor and down to the floor by means of the controllable winch. It is movable vertically up and down. The controller allows, in addition to the lively impression, a synchronisation of the flames with one another or with, for example, a performance being presented on the stage. However, the decorative device can also be arranged in hotel entrances, open areas of recreational parks or aisles of shopping centres. The floor can be a stage floor, but also a floor of an audience space, the ground or the like.

The term "elongated non-rigid element" should be understood very generally here. It may be an electrical cable, a rope, a hose, in particular a fuel hose, or the like. A combination of the aforementioned elongated non-rigid elements can also be chosen.

Depending upon the choice of the elongated non-rigid elements and the associated burner the invention has various embodiments.

The elongated non-rigid element is particularly preferably designed as an electrical cable. In this embodiment of the invention the cable is electrically connected at one end to the igniter and at another end to an electrical power supply.

The burner is connected to one end of the electrical cable not only electrically, but also mechanically, so that the burner can be moved down to the floor and up from floor by the unwinding and winding up of the electrical cable. The invention makes use of the idea of providing a controllable winch in order thereby to simultaneously use a cable, which in principle serves for the electrical power supply, to move a burner with a real flame down to a floor and up from a floor. The cable is advantageously used as both an electrical and also a mechanical connecting means.

In a further embodiment of the invention the igniter is electrically conductively connected to a battery which is arranged in or on the burner. The igniter is controllable by means of the controller via a wireless connection such as DMX, Bluetooth, WLAN or the like. The elongated non-rigid element can be designed here as a rope. Expensive cable connections can preferably be dispensed with.

In another embodiment of the invention the elongated non-rigid element is designed as a fuel hose. The fuel has the advantage that the burner can burn without limitation. In this in turn case the ignition preferably takes place by an igniter, which is controlled via a wireless connection. However, it is also conceivable that the igniter is connected to an electrical cable, so that the cable is formed from an electrical cable and a fuel hose. In this case the ignition takes place as in the particularly preferred embodiment.

In a further embodiment of the invention the burner has fastening means for elongated connecting means such as ropes, cables or rods. The fastening means can be holes, eyelets, pins or the like. The burner is advantageously suspended in a manner which is stable against tilting on three fastening means at the end of the elongated non-rigid elements. The fastening means are preferably provided on an edge of the burner.

The burner is preferably fastened by the fastening means at the cable end by means of two current-carrying wires of the electrical cable which are separated from one another. In addition to the two current-carrying wires, a third connection is preferably also provided between the cable end and a fire bowl. The current-carrying wires are separated at one end of the cable, i.e. the end nearer the burner, and extend to the fastening means of the burner, and from there they extend preferably to an electrical ignition with the electrical igniter and a valve.

The burner is preferably suspended on two or three fastening means, and two suspension means serve as current-carrying wires of the electrical connection when a cable is used. In the case of a rope suspension or in the embodiment with the fuel hose a suspension on a central fastening means is conceivable.

The burner preferably comprises the igniter and a fuel reservoir, preferably a gas reservoir. The fuel can be attached in the form of a cartridge to the burner, preferably screwed on. The igniter is designed so that when a voltage is applied to the igniter an ignition spark is generated and simultaneously an exit of gas from the gas reservoir is enabled, so that the exiting gas is ignited and a real flame is produced.

The flame is arranged above the burner, and the burner is preferably designed in terms of its length and width and provided with a casing so that the cartridge cannot be seen from the audience space, but only the flame exiting from the top from the cartridge can be seen. Thus this gives a very aesthetically pleasing impression for the viewer who is seated for example in front of the stage floor and is looking at the burner.

However, the flames can also be installed in the audience space above the public. The stage does not always have to be located below the burners.

The burner is advantageously movable to and fro between an upper and an upper turn-round point. The upper and lower turn-round points cannot be overshot or undershot. For this purpose mechanical locking and/or electronic locking is/are provided in the controller of the winch.

In a particularly preferred embodiment of the invention a heat sensor is arranged above the burner. This heat sensor can be provided, on the one hand, on an end portion of one cable end, above the burner, that is to say for instance in the portion where the cable branches into its current-carrying wires or arms, so that if a temperature is exceeded at this point the heat sensor sends a switch-off signal to the burner, so that damage to the cable or the like can be prevented. Additionally or instead, a heat sensor can also be arranged on a holding structure above the floor, so that the burner does not go beyond an upper redirection point and reach the holding structure. The fact that the burner does not go beyond the upper redirection point is achieved by a mechanical or electronic lock of the winch. The heat sensor, which is attached to the winch or above the burner on the holding structure of the winch, switches the flame off as soon as a temperature which is critical for the surroundings is reached.

Particularly preferably, not only is a winch provided with an elongated non-rigid element with a burner, but a multiplicity of burners which extend over the entire space above the floor. Each of the multiplicity of burners is connected by an elongated non-rigid element to a respective winch and is individually controllable. The winches are fastened to a holding structure and are preferably controllable jointly by means of a central controller which can be programmed.

In another embodiment the winches are arranged in a compact manner laterally adjacent to the floor. Thus it is possible for a choreography of the burners for the duration of a show to be programmed in, wherein the flames are ignited or switched off again and ignited again, etc., in a co-ordinated manner, and in this case are displaced in a co-ordinated manner in an up-and-down movement above the floor.

Particularly preferably, for each of the winches a redirection roller 3 is provided, by means of which the elongated non-rigid element associated with the winch is guided. In this embodiment the winch can be arranged laterally adjacent to the floor. The redirection roller is provided above the floor on the holding structure or the like.

In this case the holding structure preferably covers the entire floor or also only regions of the floor. One redirection roller is arranged on the holding structure, or a plurality of redirection rollers are arranged there. The redirection rollers make it possible to configure an up-and-down movement of the burner perpendicular to the floor in a visually aesthetically pleasing manner by control of the winch adjacent to the floor.

Figure 1A:
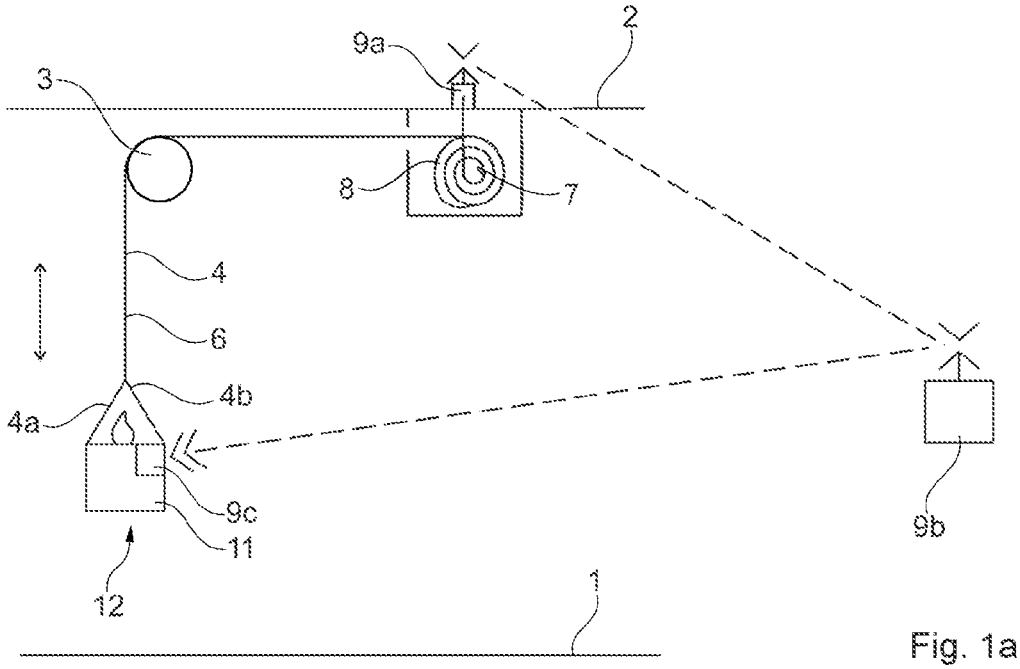
Figure 2:
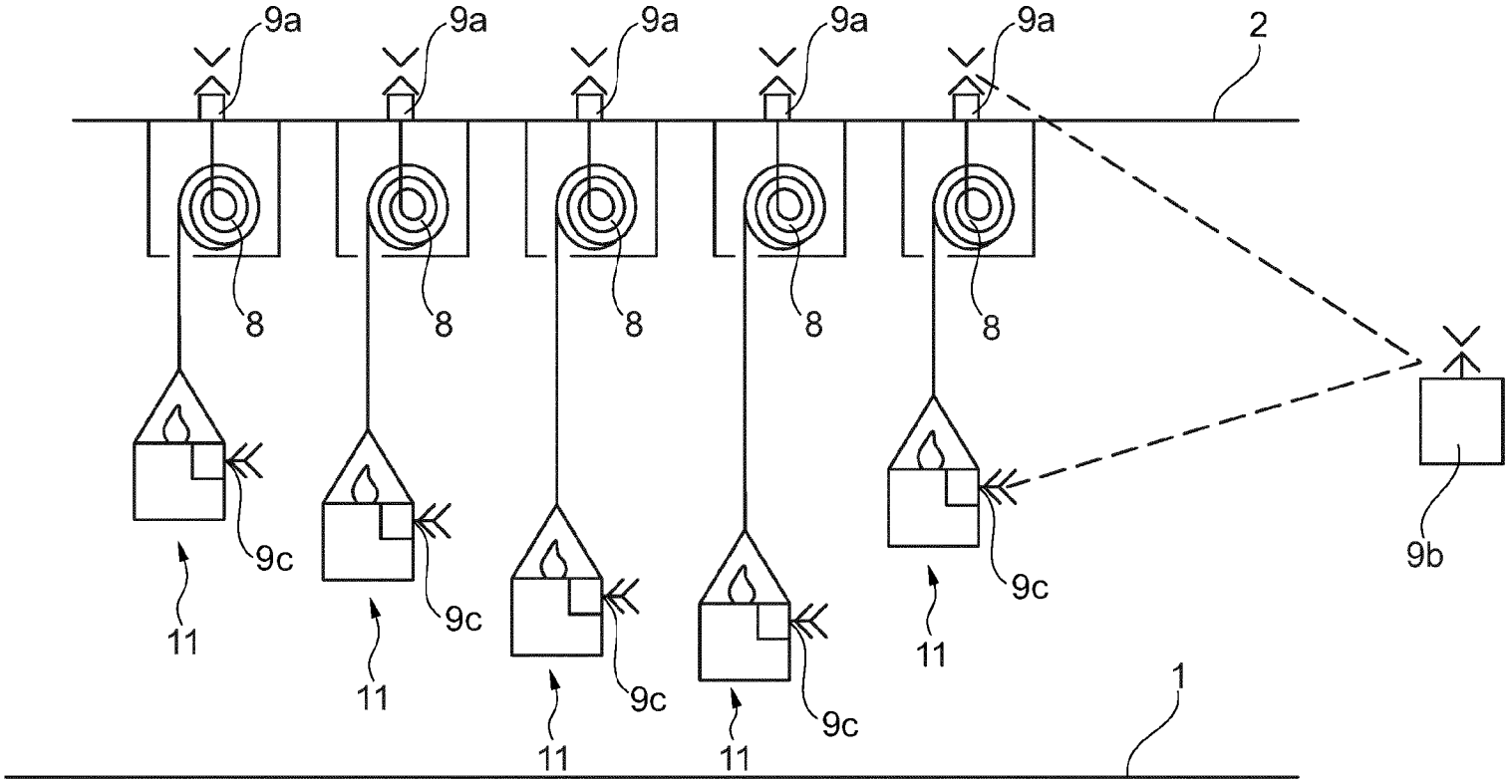

The invention is described with reference to two embodiments in two drawings. In the drawings:

FIG. 1 shows a schematic view of a decorative device with an individual controllable cable winch, FIG. 1*a* shows a schematic view of a decorative device with a redirection roller, FIG. 2 shows a decorative device with a large number of controllable cable winches.

The decorative device illustrated in FIG. 1 comprises a stage floor 1. The stage floor 1 can have dimensions of 100 $m^2$ or more for the production of major shows. However, other sizes are also conceivable. A holding structure 2 in the form of a rack, a continuous roof, a frame structure or the like is provided above the stage floor 1. In the context of this application the words "at the top" and "at the bottom" or "above" and "below" always relate to an indication of direction counter to the force of gravity or in the direction of the force of gravity.

A cable winch 8, on which an electrical cable 4 can be wound up and unwound is rotatably arranged on the holding structure 2 in the embodiment according to FIG. 1. One end 6 of the electrical cable 4 is connected to a burner, the other end 7 of the electrical cable 4 is rolled up on the cable winch 8. The cable winch 8 is controllable. In order to control the cable winch 8 a drive is provided which drives a shaft of the cable winch 8 in the clockwise direction or in the anti-clockwise direction. The drive is rotatable in the clockwise direction or in the anti-clockwise direction by means of a controller 9, wherein the angular velocity of the drive and thus of the shaft of the cable winch 8 is also controllable.

The cable 4 is a two-strand or three-strand cable, and one cable end 6 is divided into individual strands 4*a*, 4*b*. The individual strands 4*a*, 4*b* are used as a holder which is stable against tilting for a burner 11. In principle, however, other embodiments are also conceivable, in particular multi-strand cables 4 with three, four, five or a higher number of strands can also be provided, which could be used for larger burners 11 having a plurality of cartridges and potentially different flame colours.

The burner 11 comprises a controllable valve, an igniter and a fire space in which the flame can form. The fire space is the free space between the strands 4*a*, 4*b*, in which the flame can spread out. The flame can even spread out over the strands 4*a* and 4*b*, in particular laterally but also upwards, if jets of flame are formed. The burner 11 is connected to a fuel reservoir for LPG (liquefied petroleum gas) or another combustible liquid, for example alcohols. The fuel reservoir is arranged behind a casing of the burner 11 and is not visible to the viewer. The fuel reservoir in this exemplary embodiment is a cartridge which can be screwed into the burner 11. The controllable valve is provided in order to regulate the flow of gas or liquid.

However, the burner 11 can also have completely different outer casings. It can also be designed as a fire bowl or flat-sided geometric shape, in particular as a platonic body.

In principle, it is also conceivable that the burner 11 has an upright fuel feed. This feed can be designed for example in the form of a fuel hose 4*c* which supports the burner 11.

An electrical igniter can be provided at a gas outlet of the burner 11. The igniter is designed as an electric arc igniter, piezoelectric igniter, glow igniter or pyrotechnic igniter which ignites the ignitable gas.

The igniter is connected by means of the strands 4*a*, 4*b* of the cable 4 to a voltage source which is electrically connected to the other cable end 7 which is wound up on the cable winch 8. A voltage is applied via the cable 4 to the igniter of the burner 11 by the application of a voltage to the other cable end 7, and ignition takes place by electric arc or switching on of an incandescent coiled filament or a pyrotechnic igniter and by opening of the gas feed during or just before the ignition, so that by application of the voltage a flame immediately forms on the burner 11. A lasting flame or a jet of flame is formed.

The burner 11 is advantageously designed so that in the viewing direction from an audience space arranged in front of the stage floor 1, preferably obliquely at the bottom in front of the stage floor 1, the cartridge 12 is concealed, but the flame remains visible; thus an impressive visual impression of a flame floating above the stage floor 1. By unwinding of the cable 4 from the cable winch 8 or winding up of the cable 4 onto the cable winch the cable 4 can be lengthened or shortened between the cartridge 12 and the cable winch 8, so that the burner 11 is moved up and down above the stage floor 1, depending upon how the cable winch 8 rotates. This movement is illustrated by double arrows in FIG. 1 and FIG. 2. In the audience space an impressive image is produced of a freely flying flame which moves up and down. The cable 4 is preferably kept dark and against a correspondingly dark background it cannot be seen or can hardly be seen.

The decorative device according to the invention is formed in its entirety in an arrangement such as can be seen by way of example in FIG. 2. A three-dimensional arrangement of a plurality of burners 11 is illustrated in FIG. 2. Thus they only extend over a width of the stage floor 1, but in particular also along a depth of the stage floor 1 and, furthermore, they can be positioned at various controllable heights above the stage floor 1. Burners 11 are positioned over the entire three-dimensional space above the stage floor 1.

A large number of burners 11 is arranged above the entire extent of the stage floor 1. A discrete cable winch 8 is assigned to each of the electrical cables 4. The cable winches 8 are fastened to the holding structure 2. Each of the cable winches 8 is provided with a controlled drive, and all drives are controllable individually, but also centrally by means of a controller 9. The controller 9 comprises a first transmitter/receiver unit 9*a* on each cable winch 8 which controls the associated drive and, in the event that the fuel feed is controlled separately on the burner 11, a second transmitter/receiver unit 9*c* for the control valve belonging to the burner. In addition it has a central transmitter/receiver unit 9*b* for all first and second transmitter/receiver units 9*a*, 9*c*. Thus, by programming of the central transmitter unit 9*b* over the course of the stage show, a choreography of a flame stage show can be presented by temporarily switching on and off the individual flames and flame combinations and in combination with up-and-down movements of the flames. Using the ATM protocol the central transmitter/receiver unit 9*b* sends control signals via a wireless connection to the first and second transmitter/receiver units 9*a*, 9*c* and receives control signals from these units using this protocol.

An upper and lower redirection point is programmed into the controller 9 of each cable winch 8. Mechanical locks can also be provided on the cable 4, so that the flame cannot be raised higher and thus closer to the holding structure 2 than the upper redirection point and cannot be lowered below a lower redirection point towards the stage floor 1.

A further safety mechanism can be provided by the provision of a heat sensor 13 according to FIG. 1 above the burner 11 and advantageously below the cable winch 8 on a casing of the cable winch 8. The heat sensor 13 is connected in a signal-conducting manner to the associated burner 11 of the first transmitter/receiver unit 9*a*. If the heat sensor 13 measures a predeterminable, specific threshold temperature and the threshold temperature is exceeded, the heat sensor 13 sends a switch-off signal via the first transmitter/receiver unit 9*a* to the central transmitter/receiver unit 9*b*, which in turn passes on the switch-off signal to the associated second transmitter/receiver unit 9*c*, and the control valve turns off the fuel feed, and the flame goes out.

In other embodiments the heat sensor 13 interrupts the signal to the burner 11, which is transmitted via either the unwindable cable 4 or a wireless connection.

LIST OF REFERENCE NUMERALS

1 stage floor
2 holding structure
3 redirection roller
4 electrical cable
4*a* strand
4*b* strand
4*c* fuel hose
6 one cable end
7 other cable end
8 cable winch
9 controller
9*a* first transmitter/receiver unit
9*b* central transmitter/receiver unit
9*c* second transmitter/receiver unit
11 burner
12 cartridge
13 heat sensor

The invention claimed is:

1. Decorative device comprising a plurality of controllable winches (8) which is intended for unwinding and winding up in each case one elongated non-rigid element (4), and the elongated non-rigid element (4) is connected to a respective burner (11) at one end (6) and to the at least one winch (8) at another end (7), and each of the burners (11) can be moved down towards the floor (1) and up away from the floor (1) with the unwinding and winding up of the elongated non-rigid element (4), characterised in that each of the burners (11) can be ignited to generate a flame by means of an igniter via a controller (9) arranged outside the burner (11) and the winches (8) are controllable by the controller (9) and a choreography is programmed into the controller (9).

2. Decorative device according to claim 1, characterised in that the elongated non-rigid element comprises an electrical cable (4) and the igniter of the burner (11) is electrically conductively connected to one end (6) of the electrical cable (4) and the controller (9) controls a voltage on the igniter via the electrical cable (4).

3. Decorative device according to claim 1, characterised in that the burner (11) is electrically conductively connected to an accumulator arranged in or on the burner (11) and the controller (9) controls a voltage on the igniter via a wireless connection.

4. Decorative device according to claim 3, characterised in that the controller (9) comprises a central transmitter/receiver unit (9*b*), and at least one first transmitter/receiver unit (9*a*) on each of the at least one winch (8) and the at least one first transmitter/receiver unit (9*a*) controls a respective drive of the at least one winch (8).

5. Decorative device according to claim 1, characterised in that the burner (11) is suspended by means of two wires (4*a*, 4*b*) of the electrical cable (4) which are separated from one another.

6. Decorative device according to claim 1, characterised in that the elongated non-rigid element is designed as a fuel hose and the burner (11) is suspended by means of the fuel hose (4*c*).

7. Decorative device according to claim 1, characterised in that a number of winches (8) and a number of burners (11) is provided and each winch (8) is associated with precisely one burner (11).

8. Decorative device according to claim 1, characterised in that a redirection roller (3) is associated with the at least one winch (8), which is arranged above the floor (1) and redirects one element end (6) associated with the at least one winch (8) towards the floor (1).

9. Decorative device according to claim 4, characterised in that the burner (11) comprises a fuel reservoir and the controller (9) comprises a second transmitter/receiver unit (9*c*) which is connected in a signal-conducting manner to a control valve of the burner (11).

10. Decorative device according to claim 1, characterised in that a heat sensor (13) which sends a switch-off signal to the first transmitter/receiver unit (9*a*) is arranged on the at least one winch (8).

11. Decorative device according to claim 1, characterised in that the elongated non-rigid element (4) is formed as a rope.

* * * * *